US006746383B2

(12) United States Patent
Yu

(10) Patent No.: US 6,746,383 B2
(45) Date of Patent: Jun. 8, 2004

(54) MULTIPURPOSE HAND PULLER

(75) Inventor: Hui-Nan Yu, Taoyuan (TW)

(73) Assignee: Jao-Hsing Tsai, Hsinchu (TW)

( * ) Notice: Subject to any disclaimer, the term of this patent is extended or adjusted under 35 U.S.C. 154(b) by 166 days.

(21) Appl. No.: 10/138,255

(22) Filed: May 6, 2002

(65) Prior Publication Data

US 2003/0207741 A1 Nov. 6, 2003

(51) Int. Cl.[7] ..... A63B 69/00
(52) U.S. Cl. ..... 482/127; 482/132; 482/123
(58) Field of Search ..... 482/127, 132, 482/123, 121, 96, 95, 62, 126, 907

(56) References Cited

U.S. PATENT DOCUMENTS 5,437,591 A * 8/1995 Chen ..... 482/127
6,203,476 B1 * 3/2001 Wang et al. ..... 482/121
6,500,105 B1 * 12/2002 Kuo ..... 482/123
6,544,153 B2 * 4/2003 Lee ..... 482/136

* cited by examiner

*Primary Examiner*—Jerome W. Donnelly
(74) *Attorney, Agent, or Firm*—Troxell Law Office PLLC

(57) ABSTRACT

A multipurpose hand puller mainly comprises at least one set of hand pullers, pedals, handgrips and operation levers, in which each set of the puller consists of a casing, brake mechanism, sheave and pulling rope. The delicately designed structure and diverse manipulation of a handgrip and operation lever provide a great number of combination and multipurpose exercises with least space occupied and maximum benefit achieved.

4 Claims, 9 Drawing Sheets

MULTIPURPOSE HAND PULLER

FIELD OF THE INVENTION

This invention relates to a multipurpose hand puller, in particular, it can be used individually or in combination as the player desires.

BACKGROUND OF THE INVENTION

Most universal gyms consist of many body-building mechanisms to train players in arms, waist and legs. In general, each mechanism is composed of a plurality of metal weighs linked with a control steel rope and retaining pin to produce an up-down movement. However, to suit the individual capability, the player has to adjust the number of weighs with great care, or it would render sports injury. Under this circumstance, certain amount of weighs are never used since purchased; the extra number of weighs are a big waste. In addition, it is easy to lead to occasional injury when the player handles the weigh adjustment carelessly.

The universal gym has an inherent deadlock, which is hard to break through. The inventor has dealt with production and sale of such sports good for years and have been dedicated to the study for improvement and finally come up with this multipurpose hand puller.

SUMMARY OF THE INVENTION

The main purpose of the invention is to provide a multipurpose hand puller. With delicate design and combined manipulation of handgrip and operation lever, it can produce diversified exercises. It occupies the least space and gains the maximum benefit.

The invention is explained in great details with the aid of preferable embodiments as illustrated in the attached drawings.

DETAILED DESCRIPTION OF THE INVENTION

Figure 1:
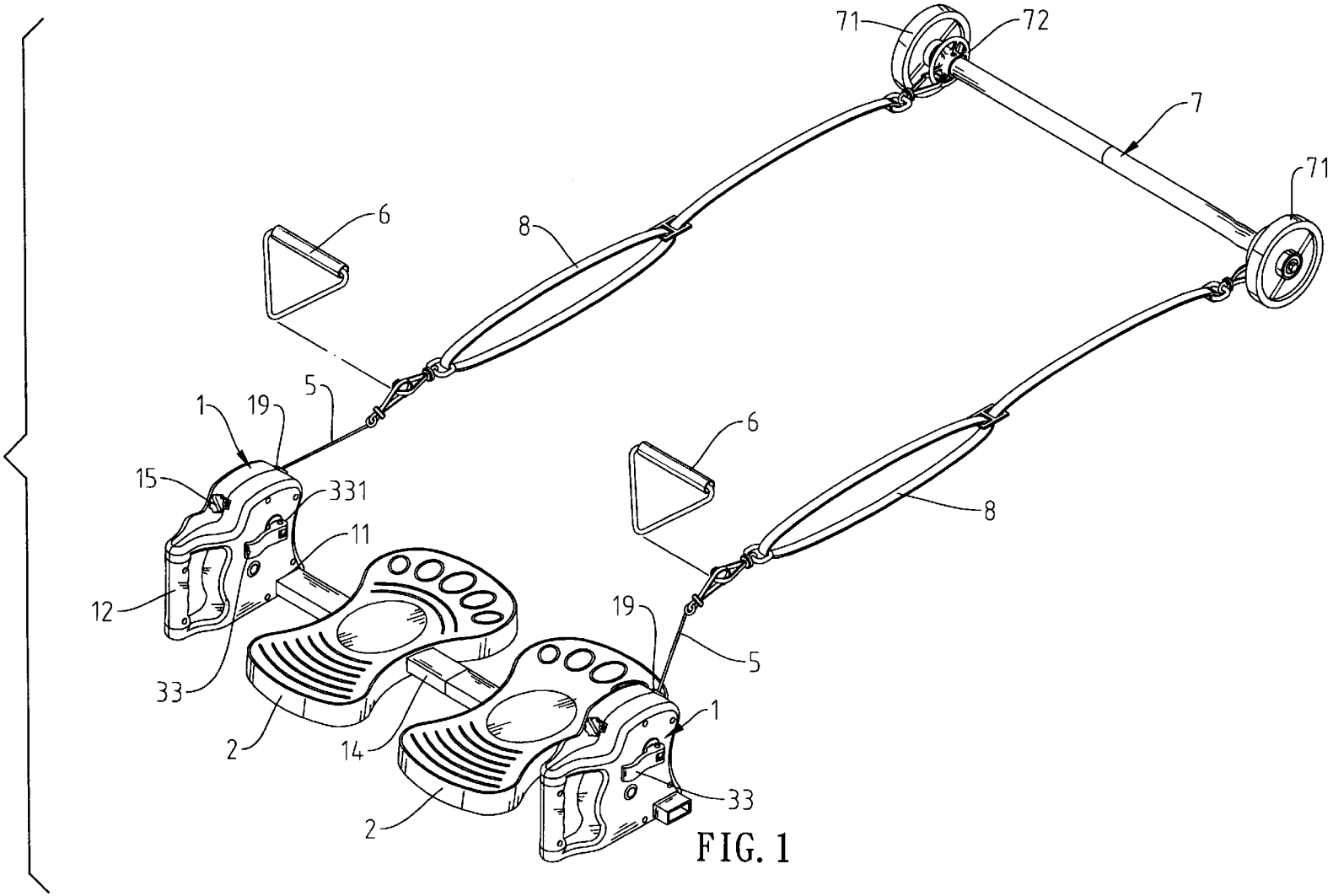
FIG. 1 is a stereo view of the hand puller of the invention.
Figure 2:
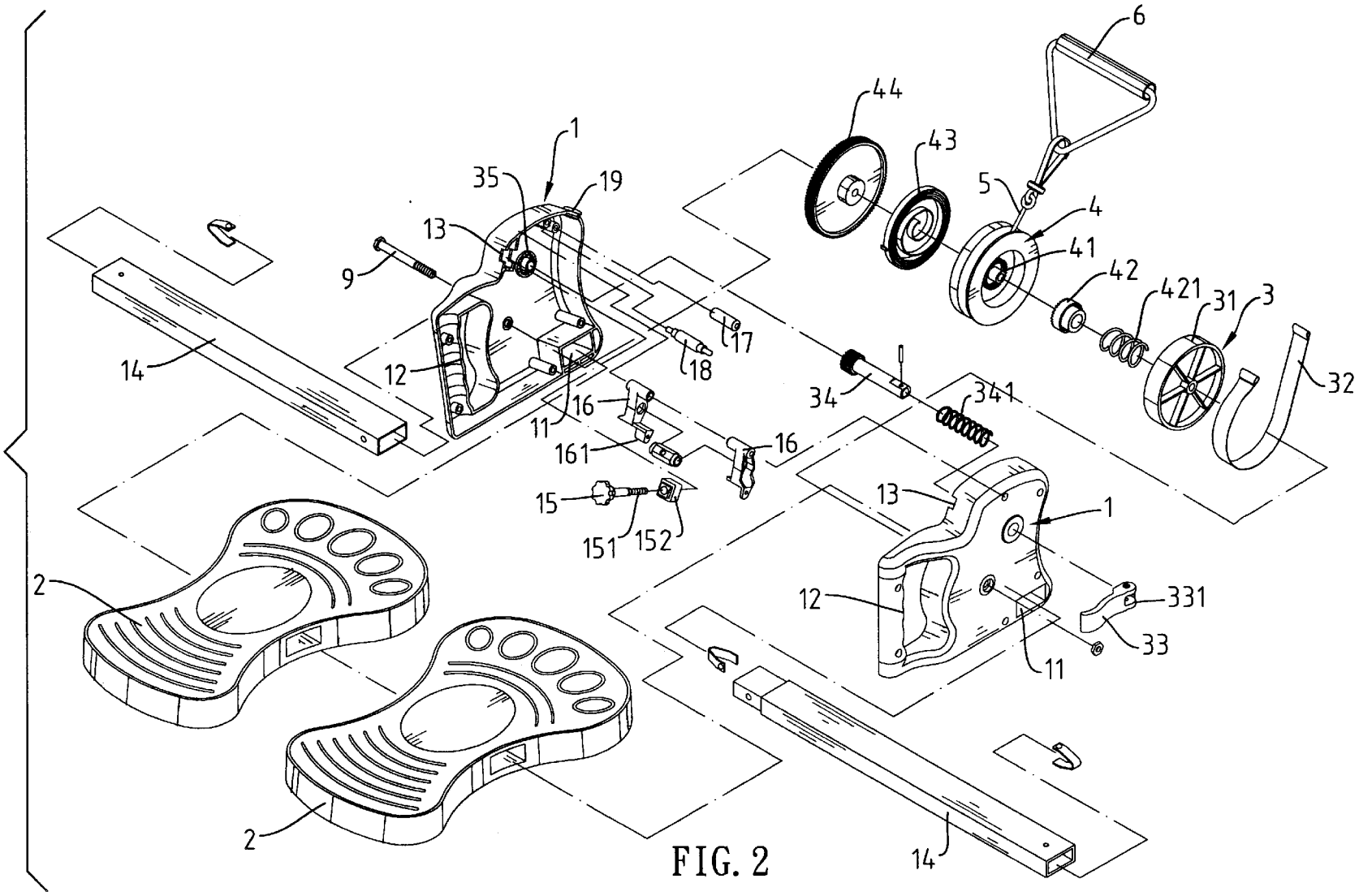
FIG. 2 is a disassembly of the hand puller of the invention.

As shown in FIGS. 1 and 2, the multipurpose hand puller mainly comprises at least one set of hand puller including a pedal 2 and a handgrip 6. Each set of puller embraces a casing 1, a brake mechanism 3, a sheave 4 and a section of pulling rope 5. The casing 1 is composed of two half shells to be mounted with the brake mechanism 3, sheave 4 and pulling rope 5 within. At the lower right corner, there is a lock hole 11, allowing a lock rod 14 to go through and lock the two shells together. The casing 1 has an opening 13 and rope outlet 19 from which the pulling rope 5 extends out of the casing 1. The opening 13 permits the insertion of a compression knob 15 with a screw section 151 and the stiffening washer 152. The screw section 151 contacts the worm rod 161, which is clamped between two mobile brackets 16. The bracket 16 is adjusted to obtain a proper working angle by turning the compression knob 15. The rope reel 17 and reel axle 18 are fastened in the casing 1 so allowing the pulling rope 5 to extend outside of the casing 1.

Figure 6:
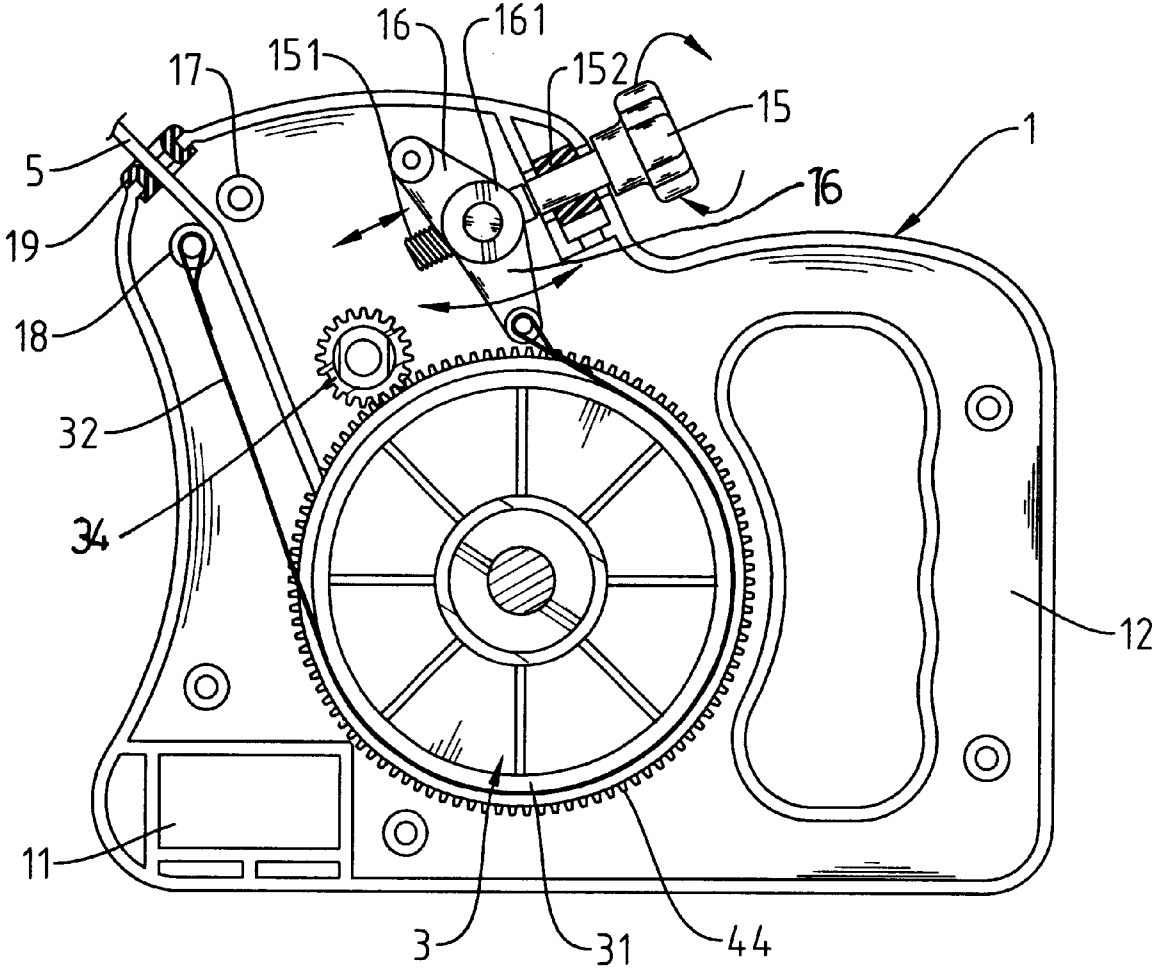
FIG. 6 is a horizontal cross section of the casing of the hand puller of the invention.
Figure 7:
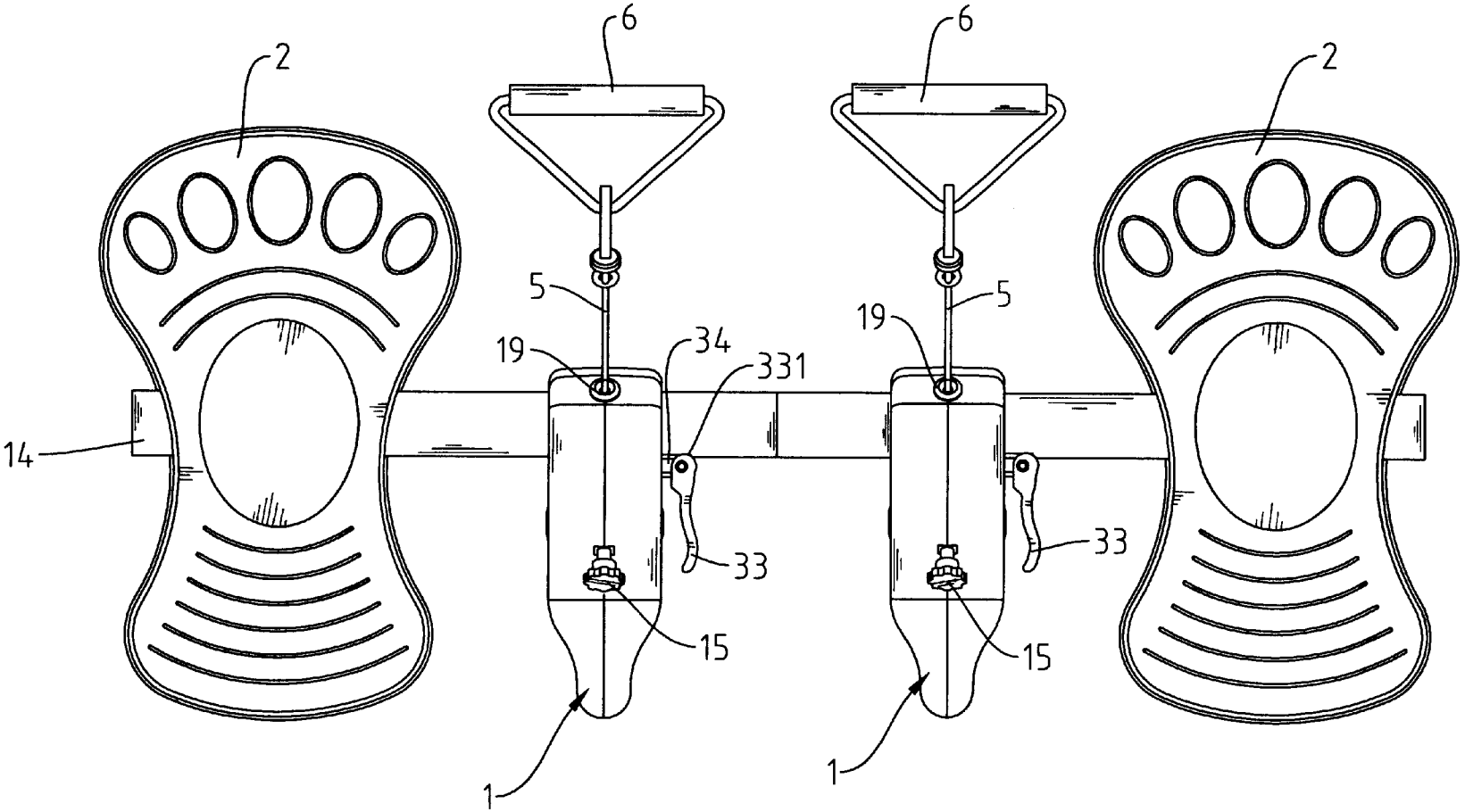
FIG. 7 shows another embodiment of the hand puller of the invention.

The brake mechanism 3 comprises a brake drum 31, brake lining 32, a handbrake lever 33, a threaded rod 34 and a lock nut 35. The brake mechanism 3 is a stepless load device. A connecting rod 9 is used to link and fasten the brake drum 31, the sheave 4, and the gear 44 together in the casing 1. The brake lining 32 has one end fixed on the reel axle 18 and other end linked to mobile bracket 16. Turning the compression knob 15 and adjusting the angle of the mobile bracket 16 are to loosen or to tighten friction force applied by the brake lining 32 on the brake drum 31 as shown in FIG. 6. When the friction increases, more resistance the brake drum 31 is encountered, and more load is added to the sheave 4.

The sheave 4 is wound with pulling rope 5 on its outer perimeter, loaded with a torque spring 43 and gear 44 on one side and a ratchet house 41 on other side to receive ratchet 42 and ratchet spring 421. The gear 44 closely contacts the threaded rod 34 of the brake mechanism 3.

The threaded rod 34 is sleeved with spring 341 and contacts with the handbrake lever 33 outside of the casing 1. When the handbrake lever 33 is turned upward, the cam 331 will push the threaded rod 34 forward so as to disengage the lock nut 35.

Figure 4:
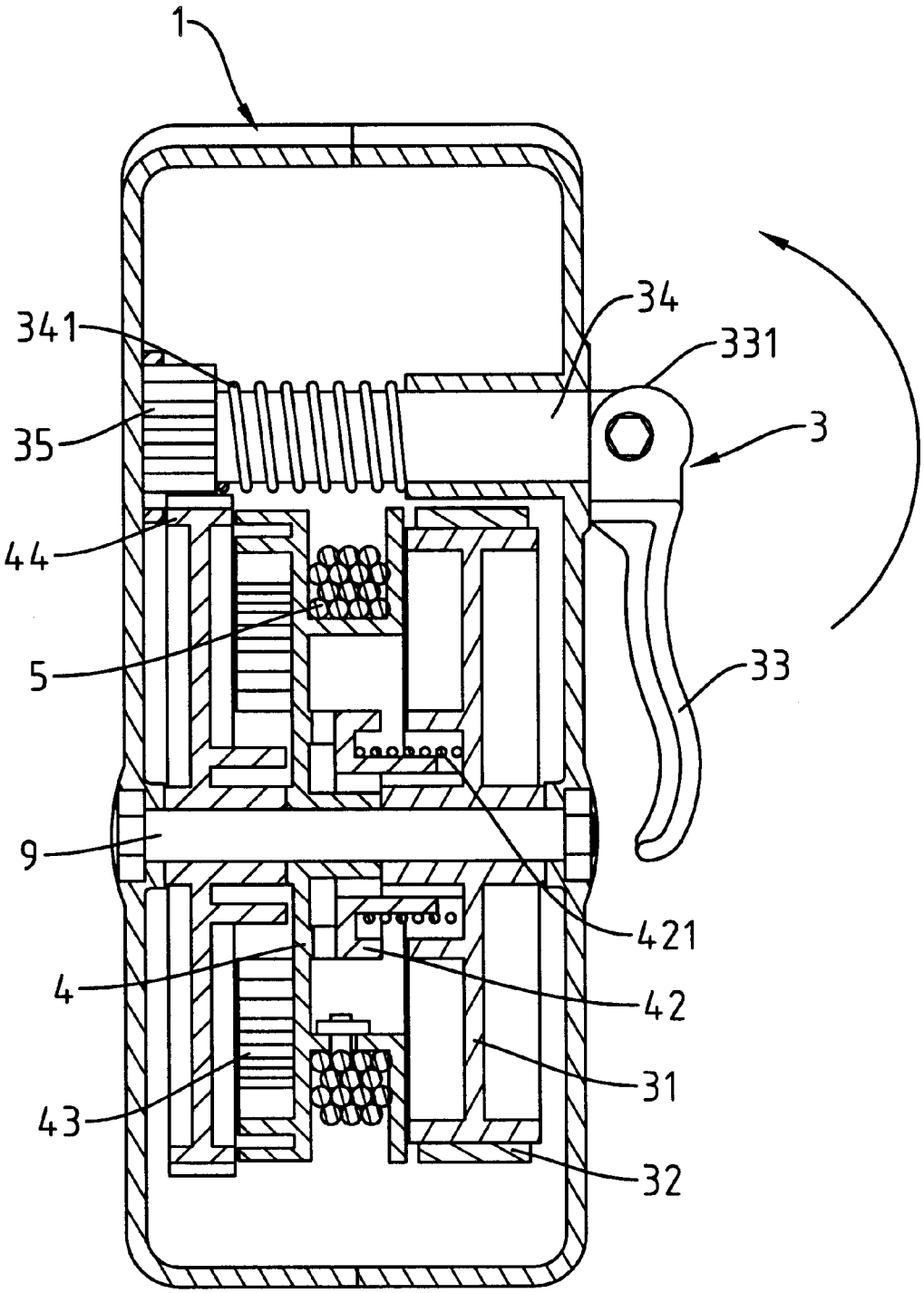
FIG. 4 is a vertical cross section of the casing of the hand puller of the invention.
Figure 5:
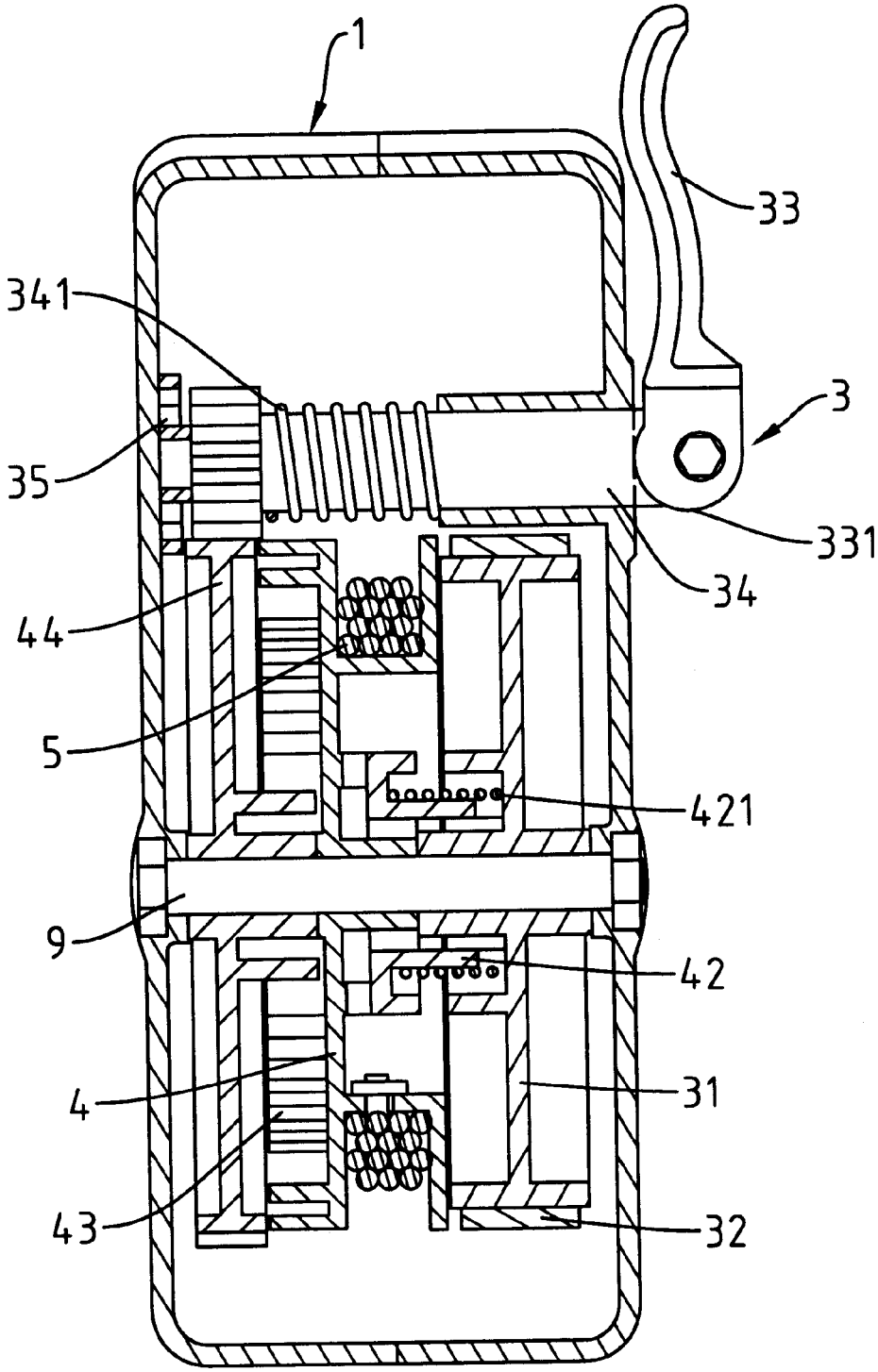
FIG. 5 show a casing as shown in FIG. 4 is in operation

As shown in FIGS. 4 through 6, when the compression knob 15 is screwed inward, the brake drum 31 produces considerable resistance imposed on the sheave 4, that means it requires more strength to pull the pulling rope 5. In addition, the torque spring 43 also brings forth extra load to the sheave 4 too. After the force to pull the pulling rope 5 is released, the recoil force of the torque spring 43 will return the shave 4. Because the ratchet 42 permits one direction movement, which will keep the brake drum 31 and the brake lining 32 still, but the torque spring 43 will force the pulling rope 5 and the handgrip 6 backward to original position ready for the next pulling. All the components are housed in the casing 1 and to set up proper resistance and load is simply by turning the compression knob 15 as the player desires.

Figure 3:
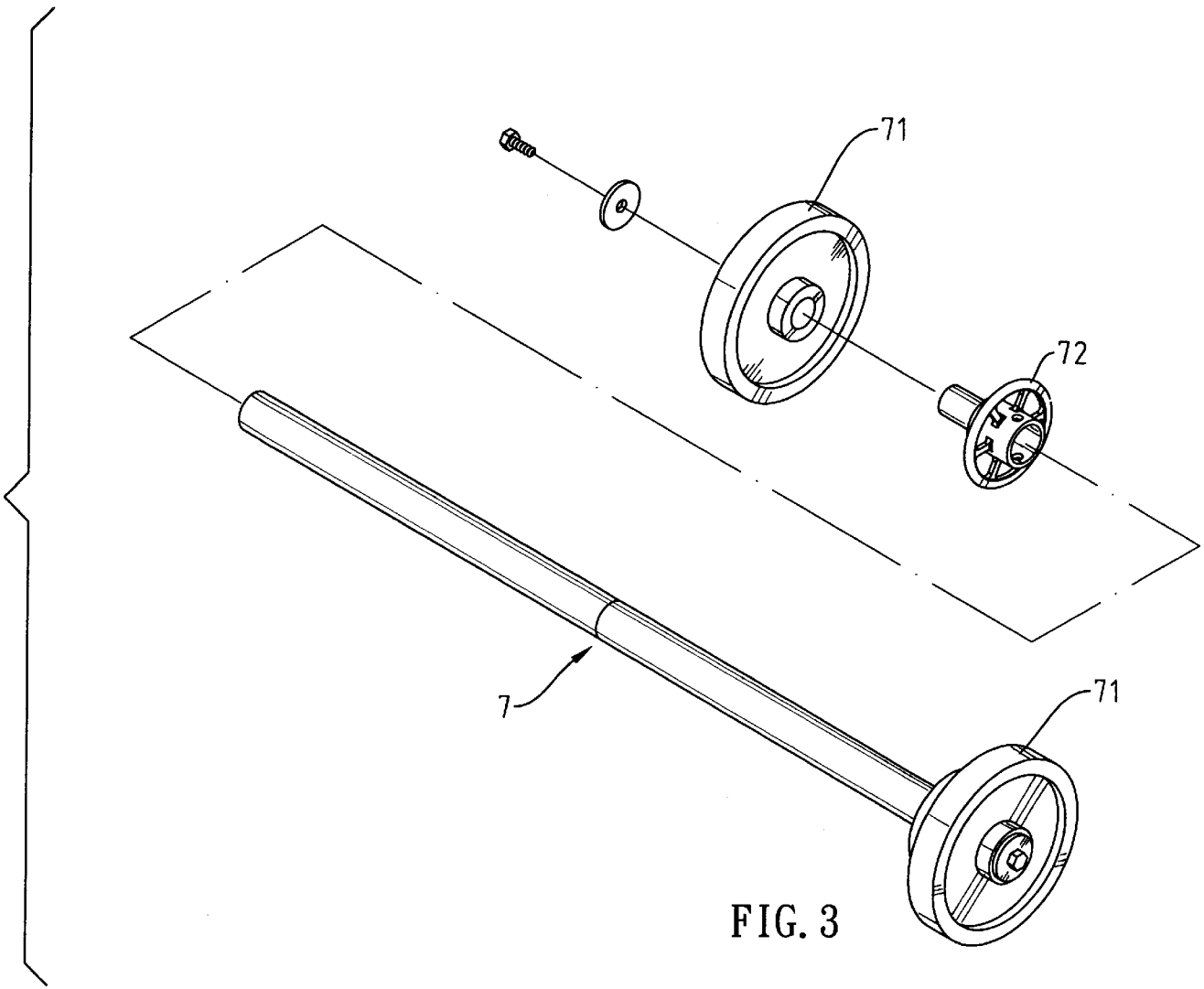
FIG. 3 is a composition of the operation lever of the hand puller of the invention.

As shown in FIGS. 1 through 3, the player can stand on two pedals 2 and hold two handgrips 6 with two hands to start pulling exercise. Besides, there is another embodiment where a control rod 7 is linked with roller 71 and hook 72, which is directly connected to the pulling rope 5. At this moment, the player is allowed to knee down on the pedals 2 and practice the forward and backward movement. In this case, if necessary, an extension band 8 will be added to get sufficient length of the puller.

Figure 8:
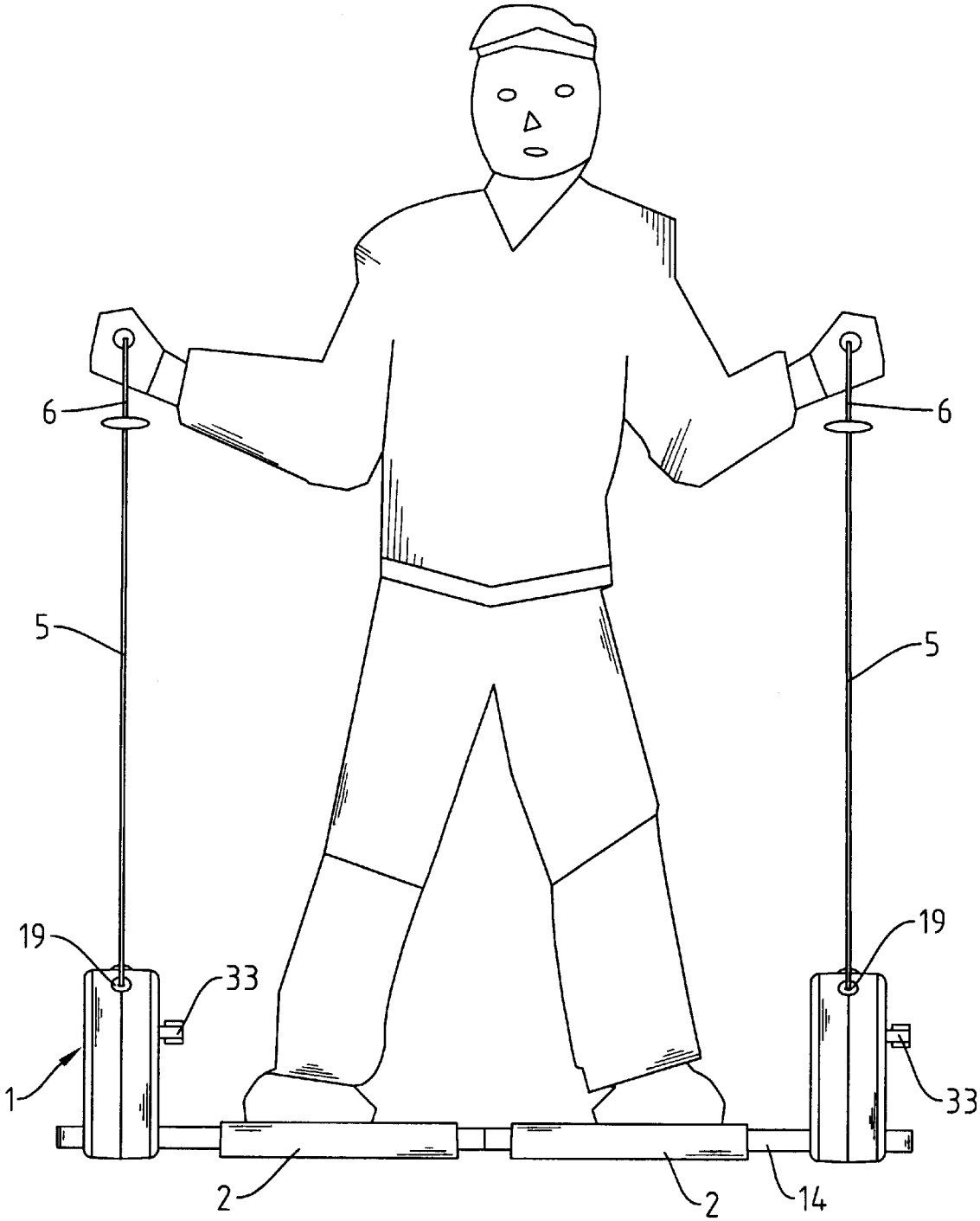
FIG. 8 is an operation diagram of the hand puller of the invention (1)
Figure 9:
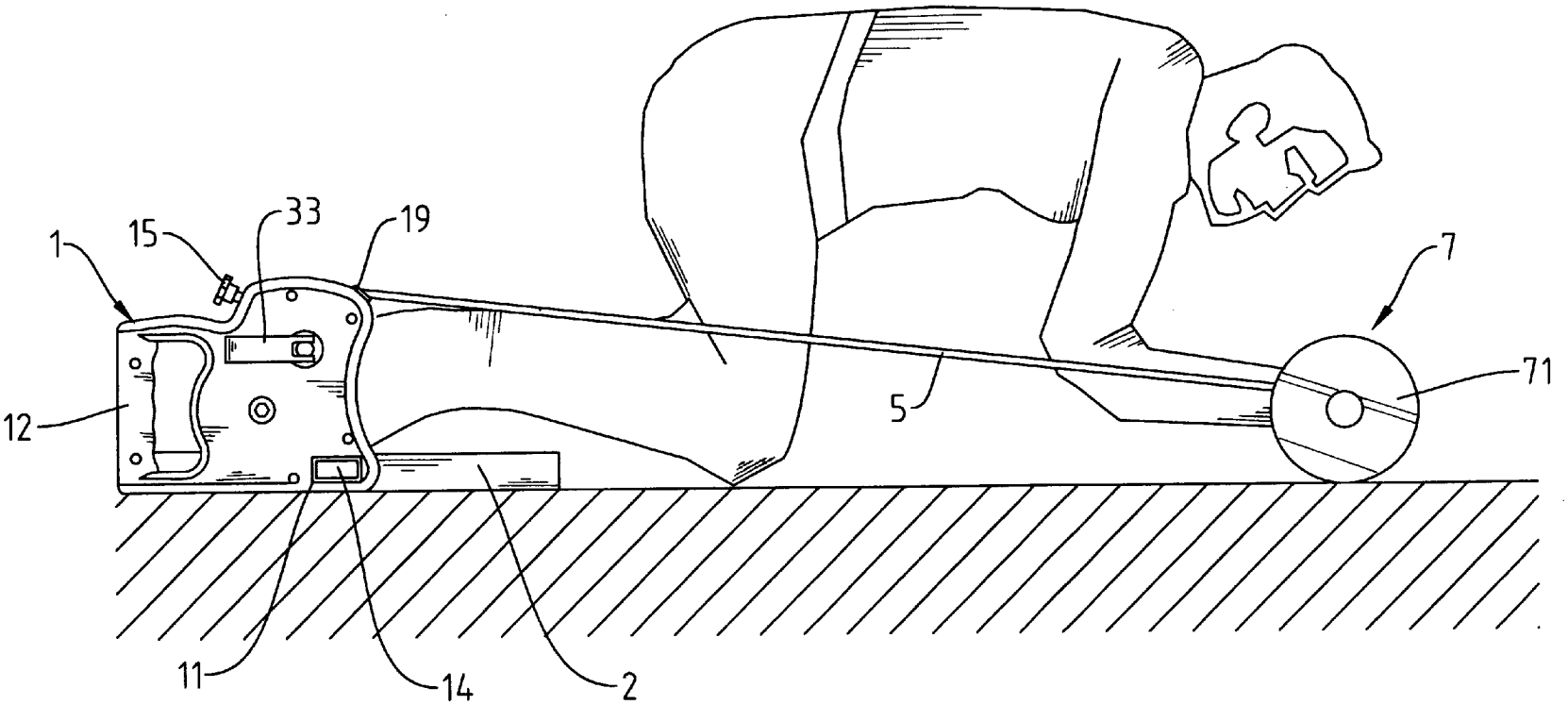
FIG. 9 is an operation diagram of the hand puller of the invention (2)

As shown in FIGS. 8 and 9, it allows the player to stand on the pedal 2 and hold the handgrips 6 to practice the pulling rope 5, or to knee down on the pedals 2 with two hands gripping the control rod 7 so as to stretch his body. The puller can be hanged on the wall or column with the pulling rope 5, so the player can hold the handle 12 on the casing 1 to have similar effect. The design of the hand puller is actually multi-functional, which meets user's need adequately.

What is claimed is:

1. A multipurpose hand puller comprising:

at least one hand puller, each hand puller having a casing, a brake mechanism, a sheave, a pulling rope and a handgrip, said casing having two half shells, said brake mechanism, said sheave and said pulling rope connected to said casing, the casing having one opening and one rope outlet, said pulling rope extending out of and connected to said handgrip, a compression knob inserted into said one opening, a rope reel and a reel axle mounted adjacent to said one rope outlet, said brake mechanism including a brake drum a brake lining, a hand brake lever and a lock rod, said brake mechanism being a stepless load device, the sheave having a ratchet, a torque spring and a gear, said pulling rope wound on a perimeter of said sheave, said ratchet located in a ratchet house and engaging a thread rod of said brake mechanism, wherein said thread rod connects said brake mechanism to said casing and engages with a cam and a handbrake lever on an outside of said casing, after said handbrake lever is lifted up, said cam presses said thread rod forward and disengages said lock rod, said brake lining has one end fixed on said sheave and other end connected to a mobile bracket, when said compression knob is turned, said threaded section and a worm rod will displace said mobile bracket to force said brake lining to loosen and tighten contact on said brake drum, such that a diverse resistance is produced to fit player's desire; the housing having a lock hole through which said lock rod is inserted and locking at least one set of puller and two pedals in place; and said pulling rope is connected to said handgrip.

2. The multipurpose hand puller of claim 1, wherein said pulling rope is connected to a control rod having two rollers and two hooks located on opposing ends thereof.

3. The multipurpose hand puller of claim 1, wherein an extension band is linked between said handgrip and said control rod.

4. The multipurpose hand puller of claim 1, further comprising a handle formed on said casing, such that, when a puller is hung on a wall or column, users can practice pulling exercises.

* * * * *